US006895640B2

(12) United States Patent
Odaka

(10) Patent No.: US 6,895,640 B2
(45) Date of Patent: May 24, 2005

(54) CLIP ATTACHING STRUCTURE

(75) Inventor: Tadao Odaka, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 23 days.

(21) Appl. No.: 10/308,143

(22) Filed: Dec. 3, 2002

(65) Prior Publication Data

US 2003/0108383 A1 Jun. 12, 2003

(30) Foreign Application Priority Data

Dec. 7, 2001 (JP) ..... 2001-374760

(51) Int. Cl.[7] ..... B43K 25/00
(52) U.S. Cl. ..... 24/11 R
(58) Field of Search ..... 24/11 F, 11 CT, 24/11 HC, 11 PP, 11 R, 11 FE

(56) References Cited

U.S. PATENT DOCUMENTS 1,568,950 A * 1/1926 Ballou ..... 24/11 F
2,318,950 A * 5/1943 Larmour ..... 24/11 F
2,453,491 A * 11/1948 Cardin ..... 24/11 F X
2,489,144 A * 11/1949 Lanoie ..... 24/11 F
5,570,965 A * 11/1996 Coolen

FOREIGN PATENT DOCUMENTS

DE 19502460 8/1996
DE 19502461 8/1996

* cited by examiner

*Primary Examiner*—Daniel P. Stodola
*Assistant Examiner*—Ryan M. Flandro
(74) *Attorney, Agent, or Firm*—McGinn & Gibb, PLLC

(57) ABSTRACT

To provide a clip attaching structure wherein a base portion of a clip is not exposed from an outside, and attaching can be performed with a good appearance. An outer sleeve has a rear sleeve and a cap connected to a rear side of the rear sleeve, and the clip has a ring-like base portion fixed to the outer sleeve, a connecting portion extending from the base portion, and a clip main body extending approximately in parallel with the rear sleeve from the connecting portion. At the rear end portion of the rear sleeve, a bent portion is formed, and in the bent portion, a notch penetrated by the connecting portion and a second notch facing to the notch by about 180 degrees are formed. The base portion of the clip passes through the portion in the diameter direction of the rear end opening connecting the notch and the second notch, and goes through the bent portion, and is inserted into an inside of the bent portion of the rear sleeve. The connecting portion has a curved shape to project backward so that a portion thereof comes into contact with an end surface of the cap.

10 Claims, 9 Drawing Sheets

CLIP ATTACHING STRUCTURE

BACKGROUND OF THE INVENTION

1. Field of the Invention

The present invention relates to a clip attaching structure whereby a clip is attached to an outer sleeve of a writing instrument or the like, and particularly, relates to a clip attaching structure whereby the clip can be attached with a good appearance.

2. Description of the Related Art

FIGS. 14A and 14B show an example of conventional clip attaching structures of this kind. In FIG. 14, an outer sleeve 50 (whose front portion is not shown) is comprised of a first outer sleeve 52 and a second outer sleeve 54 which is on a rear side of the first outer sleeve 52 and whose tip end portion is inserted into the first outer sleeve 52. A male threaded portion 54*a* formed in a tip portion of the second outer sleeve 54 is screwed into a female threaded portion 52*a* formed on the first outer sleeve 52, and the second outer sleeve 54 is connected to a rear side of the first outer sleeve 52. Furthermore, a clip 56 has a ring-like base portion 56*a* fixed to the outer sleeve 50, a connecting portion 56*b* extending from the base portion 56*a*, and a clip main body 56*c* extending approximately in parallel with the outer sleeve 50. The tip portion of the second outer sleeve 54 penetrates the ring-like base portion 56*a* of the clip 56, and when the male threaded portion 54*a* in the tip portion is screwed into the female threaded portion 52*a* formed in the first outer sleeve 52, the ring-like base portion 56*a* is held and fixed between the rear portion of the second outer sleeve 54 and the rear end portion of the first outer sleeve 52.

However, in the case of the structure shown in FIG. 14, the base portion 56*a* of the clip 56 is seen from an outside, a problem is that the appearance is impaired.

SUMMARY OF THE INVENTION

The present invention is achieved to solve such a problem, and it is an object thereof to provide a clip attaching structure wherein the base portion of the clip is not exposed from the outside, and the clip can be attached with a good appearance.

In order to attain the object, in a clip attaching structure according to the present invention, a clip is attached to an outer sleeve of a writing instrument or the like. It comprises the outer sleeve including a first outer sleeve and a second outer sleeve connected to the rear side of the first outer sleeve, and the clip including a ring-like base portion fixed to the outer sleeve, a connecting portion extending from the base portion, and a clip main body extending approximately in parallel with the outer sleeve from the connecting portion. A connecting side end portion of one of the first outer sleeve and the second outer sleeve is bent from the axial direction by about 90 degrees to be a bent portion extending in an inside diameter direction, and the bent portion surrounding a connecting side opening of one of the first outer sleeve and the second outer sleeve.

A notch is formed in the bent portion, and a length in the diameter direction of the connecting side opening passing through the notch is equal to or more than the minimum length in a longitudinal direction of a projection surface made by projecting the ring-like base portion of the clip from the side thereof, whereas a length in the diameter direction of the connecting side opening not passing through the notch is equal to or less than the maximum length in the longitudinal direction of the projection surface made by projecting the ring-like base portion of the clip from the side thereof.

The ring-like base portion of the clip can pass through the portion in the diameter direction of the connecting side opening passing through the notch, to be inserted into an inside of one of the first outer sleeve and second outer sleeve, and the base portion of the clip passing through the bent portion is positioned in the inside of one of the first outer sleeve and the second outer sleeve.

Since the base portion of the clip passes through the bent portion of one of the first outer sleeve and the second outer sleeve to be positioned in the inside thereof, the base portion of the clip is not seen from the outside, and a good appearance can be obtained. Since the bent portion is formed in one of the first outer sleeve and the second outer sleeve, the diameter of the connecting side opening thereof is reduced. However, the length in the diameter direction of the connecting side opening passing through the notch is set to be equal to or more than the minimum length in the longitudinal direction of the projection surface made by projecting the ring-like base portion of the clip from the side thereof, and therefore, the base portion of the clip can pass through the portion in the diameter direction of the connecting side opening passing through the notch in the state that the base portion is positioned sideways. Thus, during assembling of the clip, the base portion of the clip passes through the bent portion, and is inserted into the inside of one of the first outer sleeve and the second outer sleeve.

Once the base portion of the clip has passed and the attitude of the base portion is reset, the base portion of the clip cannot pass through the bent portion at the connecting side opening, since the length in the diameter direction of the connecting side opening not passing through the notch is equal to or less than the maximum length in the longitudinal direction of the projection surface made by projecting the ring-like base portion of the clip from the side thereof, and the base portion of the clip is surely positioned in the inside of one of the first outer sleeve and the second outer sleeve.

The two notches can be formed to be separated by about 180 degrees with facing to each other in the circumferential direction of the bent portion, and the length in the diameter direction of the connecting side opening connecting the two notches is equal to or more than the minimum length in the longitudinal direction of the projection surface made by projecting the ring-like base portion of the clip from the side thereof. During assembling of the clip, the base portion of the clip can pass through the portion of the connecting side opening passing through two notches in the state that the base portion is positioned sideways.

Furthermore, one of the two notches can be penetrated by the connecting portion of the clip.

The outside profile of the ring-like base portion of the clip can be shaped like a deformed circle where a rim(s) thereof is removed from a complete round, and the length in the diameter direction of the connecting side opening passing through the notch is equal to or more than the minimum length in the longitudinal direction of the projection surface made by projecting the ring-like base portion of the clip from the side thereof. During assembling of the clip, the base portion of the clip can pass through the portion of the connecting side opening passing through the notch in the state that the base portion is positioned sideways.

The connecting portion of the clip can be curved to project backward so that a part of the connecting portion comes into contact with the second outer sleeve. Consequently, when the clip main body is swung for using the clip, the connecting portion itself can be prevented from deforming since the connecting portion comes into contact with the second outer sleeve, and since the connecting portion has a curved shape, the stress can be prevented from concentrating, and as a result, the clip can be prevented from breaking.

The present disclosure relates to subject matter contained in Japanese Patent Application No. 2001-374760, filed on Dec. 7, 2001, which are expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

The preferred embodiments of the present invention will be described below by using drawings.

Figure 1:
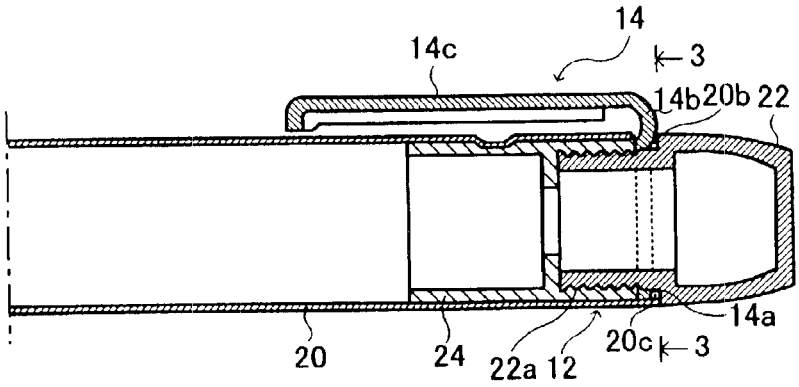
FIG. 1 is a vertical cross sectional view showing a first embodiment of a clip attaching structure according to the present invention.
Figure 2:
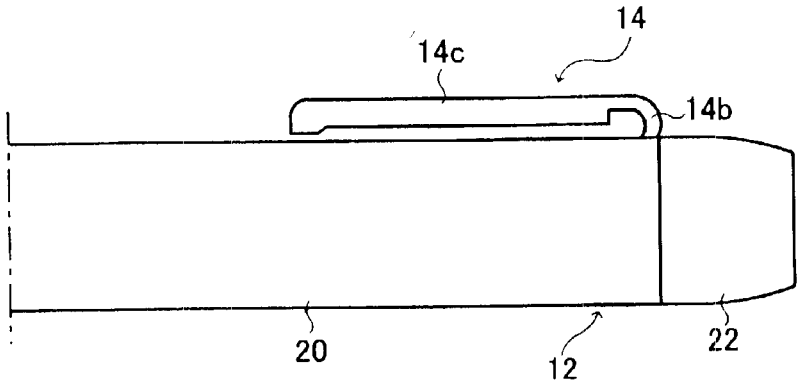
FIG. 2 is a side view of the first embodiment.
Figure 3:
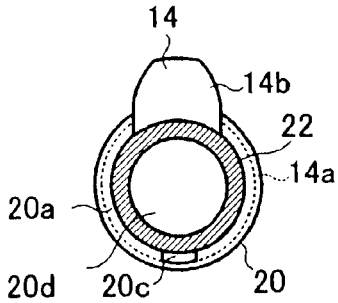
FIG. 3 is a cross sectional view seen along a line 3—3 of FIG. 1.

FIG. 1 and FIG. 2 show a part of a writing instrument having an outer sleeve 12, to which a clip 14 is attached. The outer sleeve 12 has a rear sleeve (first outer sleeve) 20 and a cap (second outer sleeve) 22 connected to the rear side of the rear sleeve 20. In the rear sleeve 20, a nut member 24 is provided. As for the nut member 24, it can be fixed to the rear sleeve 20 as shown in FIG. 1, however it can be free to the rear shaft 20. Alternatively, the nut member 24 can be an integrated part of the rear sleeve 20, instead of fixing the nut member 24 to the rear sleeve 20. The cap 22 includes a reduced diameter portion in tip portion thereof where a male threaded portion 22*a* is formed. The male threaded portion 22*a* extends into the rear sleeve 20 to be threadedly engaged with the nut member 24. Alternatively, a screw member which is a separate part from the cap 22 can be provided, instead of forming the male threaded portion 22*a* integrated with the cap 22, and furthermore, the screw member and the cap 22 may be integrally connected by other connecting means such as screwing, adhering, or pressing.

Figure 4:
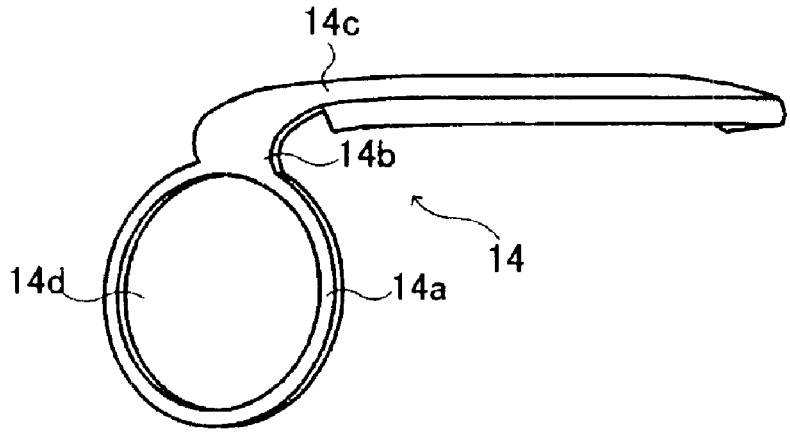
FIG. 4 is a perspective view of a clip of the first embodiment.

The clip 14 has a ring-like base portion 14*a* fixed to the outer sleeve 12, a connecting portion 14*b* extending from the base portion 14*a,* and a clip main body 14*c* extending approximately in parallel with the rear outer sleeve 20 from the connecting portion 14*b*. As shown in FIG. 4, an outside profile of the ring-like base portion 14*a* and a profile of the center hole 14*d* of the base portion 14*a* are shaped approximately like a complete round. Furthermore, the connecting portion 14*b* has a curved shape so as to project backward.

Figure 5:
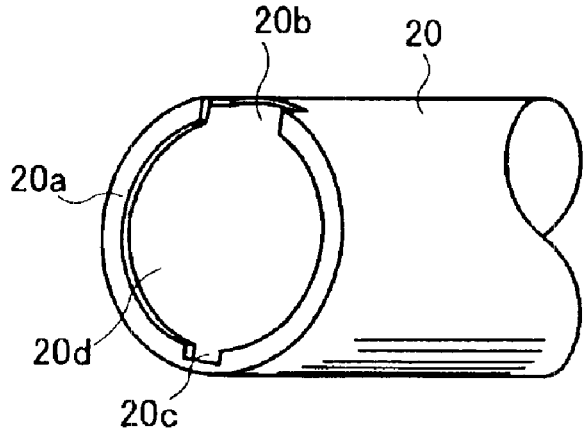
FIG. 5 is a perspective view showing a connecting side end portion (rear end portion) of a rear sleeve of the first embodiment.

As shown in FIG. 5, the rear end portion as a connecting side end portion of the rear sleeve 20 is formed with a bent portion 20*a* bent in the inside diameter direction by 90 degrees. The inside diameter except where the bent portion 20*a* is formed is approximately equal to or a little larger than the outside diameter of the outside profile of the ring-like base portion 14*a* of the clip 14, that is, in other words, the length in the longitudinal direction of the projection surface made by projecting the ring-like base portion 14*a* from the side. This means that the outside diameter of the outside profile of the ring-like base portion 14*a* of the clip 14 is larger than the inside diameter of a rear end opening 20*d* of the rear sleeve 20 surrounded and defined by the bent portion 20*a*.

At a specified position in the circumferential direction of the bent portion 20*a,* a notch 20*b* where there is no bent portion and the peripheral surface of the rear end portion is scraped is formed. This notch 20*b* is made for the insertion of the connecting portion 14*b* of the clip, and therefore, preferably, that the size measured in the circumferential direction thereof is approximately as large as the size of the connecting portion 14*b* of the clip, and it should not be too larger than the size of the connecting portion 14*b* of the clip. Furthermore, at a position separated by about 180 degrees from and facing to the position where the notch 20*b* of the bent portion 20*a* is formed, a second notch 20*c* where a part of the bent portion 20*a* is cut is formed. The length in the diameter direction of the rear end opening 20*d* connecting the notch 20*b* and the second notch 20*c* is approximately equal to or a little larger than the outside diameter of the outside profile of the ring-like base portion 14*a* of the clip 14.

Figure 6A:
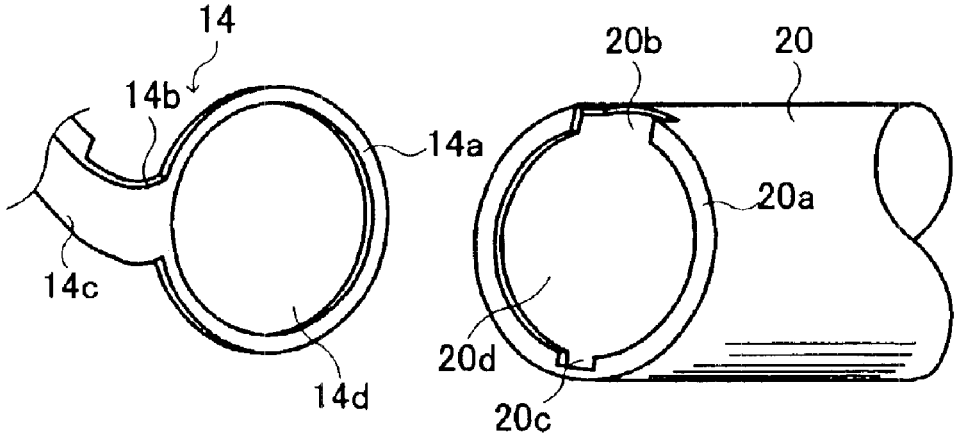
FIGS. 6A to 6D are views showing an assembling procedure of the clip of the first embodiment.
Figure 6B:
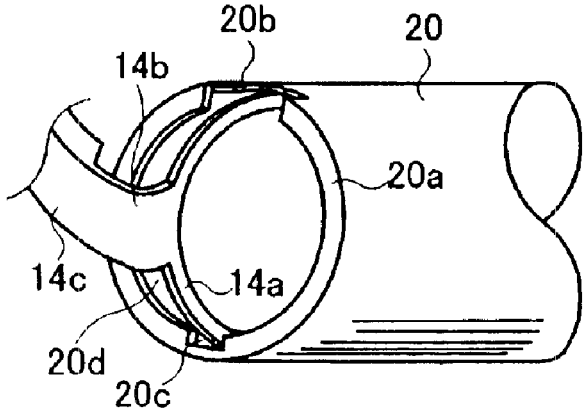
Figure 6C:
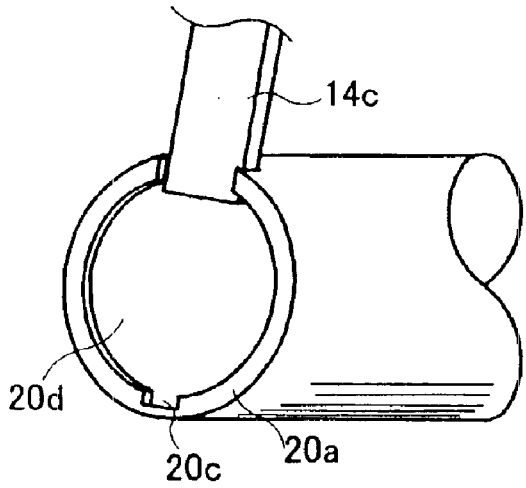
Figure 6D:
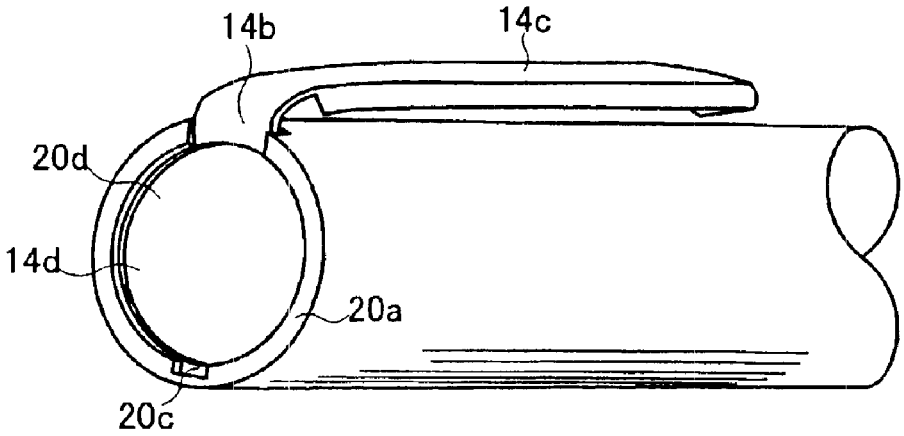

The assembling procedure of the clip attaching structure constructed as mentioned above, will be described. The base portion 14*a* of the clip 14 is inserted into the rear sleeve 20 from the bent portion 20*a* of the rear sleeve 20. Since the outside diameter of the outside profile of the base portion 14*a* is approximately equal to the inside diameter of the rear sleeve 20 except where the bent portion 20*a* is formed, and is larger than the inside diameter of the rear end opening 20*d* surrounded by the bent portion 20*a,* it is impossible to insert the base portion 14*a* into the rear sleeve 20 over the bent portion 20*a* as it is. However, the notch 20*b,* and the second notch 20*c* facing to the notch 20*b* are formed, and the size of the straight line connecting the notch 20*b* and the second notch 20*c* is approximately equal to or a little larger than the outside diameter of the outside profile of the base portion 14*a,* and therefore, the base portion 14*a* can pass through the bent portion 20*a*. As shown in FIG. 6A, the base portion 14*a* of the clip 14 is set to be approximately vertical to the rear end opening 20*d* surface of the rear sleeve 20 surrounded by the bent portion 20*a,* and is allowed to pass through the portion in the diameter direction of the rear end opening 20*d* connecting the notch 20*b* and the second notch 20*c* to pass through the bent portion 20*a.* Then, after inserting the base portion 14*a* approximately completely into the rear sleeve 20, the clip 14 is rotated (FIG. 6B) so that the connecting portion 14*b* coincides with the notch 20*b.* Furthermore, the clip 14 is rotated (FIG. 6C) so that the center hole 14*d* of the base portion 14*a* of the clip 14 is approximately in parallel to the rear end opening 20*d* surface of the rear sleeve 20. Thus, the base portion 14*a* of the clip 14 is contained in the inside of the bent portion 20*a* of the rear sleeve 20, and the connecting portion 14*b* of the clip 14 penetrates the notch 20*b,* and the clip main body 14*c* of the clip 14 extends approximately in parallel with the rear sleeve 20 (FIG. 6D).

The nut member 24 is provided in the rear sleeve 20. Then, the male threaded portion 22*a* of the cap 22 is allowed to pass through the rear end opening 20*d* of the rear sleeve 20 and the center hole 14*d* of the base portion 14*a* of the clip 14, and is screwed with the nut member 24 provided in the rear sleeve 20. Consequently, the cap 22 is connected to the rear sleeve 20, and the base portion 14*a* of the clip 14 is held and fixed between the nut member 24 and the bent portion 20*a* since it cannot pass through the bent portion 20*a.* Furthermore, a part of the portion curved to project backward of the connecting portion 14*b* of the clip 14 passing through the notch 20*b* comes into contact with the end surface of the rear portion of the cap 22. Preferably, the portion where the connecting portion 14*b* comes into contact with the cap 22 is positioned at or near the rearmost end of the connecting portion 14*b.*

The base portion 14*a* of the clip 14 attached to the outer sleeve 12 as mentioned above is positioned in the rear sleeve 20, as shown in FIG. 2, and is not seen from the outside, and therefore, it has an excellent appearance. Furthermore, when the clip main body 14*c* is swung for using the clip 14, a large deformation of the connecting portion 14*b* itself can be prevented since the connecting portion 14*b* of the clip 14 is brought into contact with the cap 22, and since the connecting portion 14*b* is curved, the stress applied to the connecting portion 14*b* can be prevented from concentrating, and the clip 14 can be prevented from breaking. At the same time, the restoring force of the clip 14 can also be raised.

Figure 13:
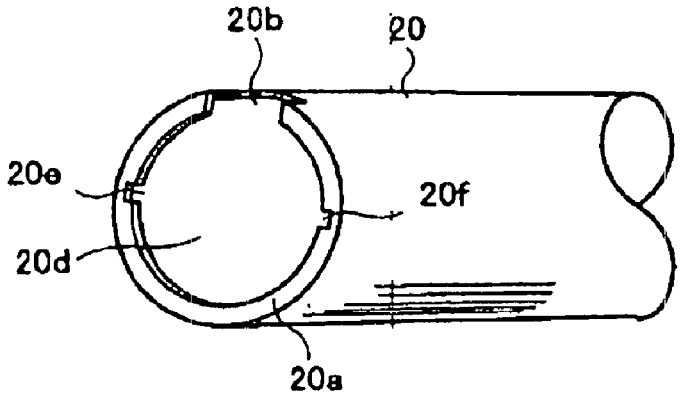
FIG. 13 is a view showing a variation of the first embodiment.
Figure 14A:
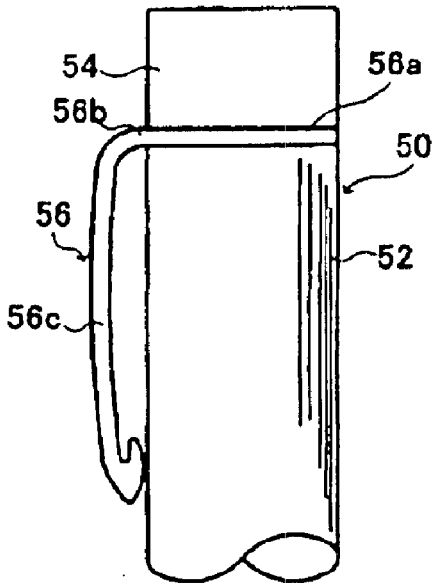
FIG.14A (PRIOR ART)
FIGS. 14A and 14B are views showing a conventional clip attaching structure.
Figure 14B:
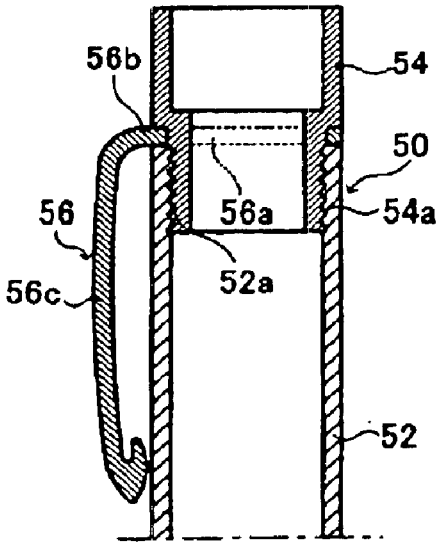
FIG.14B (PRIOR ART)

FIG. 13 is a perspective view showing the rear end portion as a connecting side end portion of the rear sleeve 20, showing a variation of the first embodiment. This variation is different from the example in FIG. 5 in that besides the notch 20*b,* at a position other than the position separated by about 180 degrees from and facing to the position where the notch 20*b* is formed, a second notch 20*e* is formed, and at a position separated by about 180 degrees from and facing to the position where the second notch 20*e* is formed, a third notch 20*f* is formed. In this example, the ring-like base portion 14*a* of the clip 14 is allowed to pass through the portion in the diameter direction of the rear end opening 20*d* connecting the second notch 20*e* and the third notch 20*f,* and is allowed to pass through the bent portion 20*a.* Thus, the ring-like base portion 14*a* of the clip 14 can be inserted into the rear sleeve 20, and the operation and effect similar to those of the first embodiment can be obtained.

Figure 7:
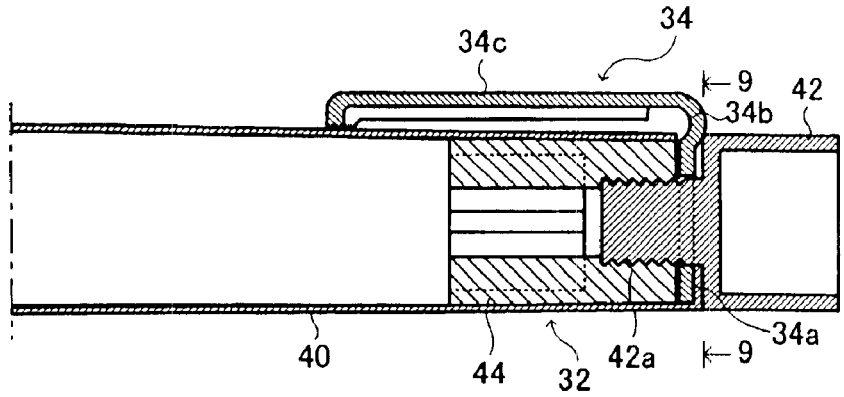
FIG. 7 is a vertical cross sectional view showing a second embodiment of the clip attaching structure according to the present invention.
Figure 8:
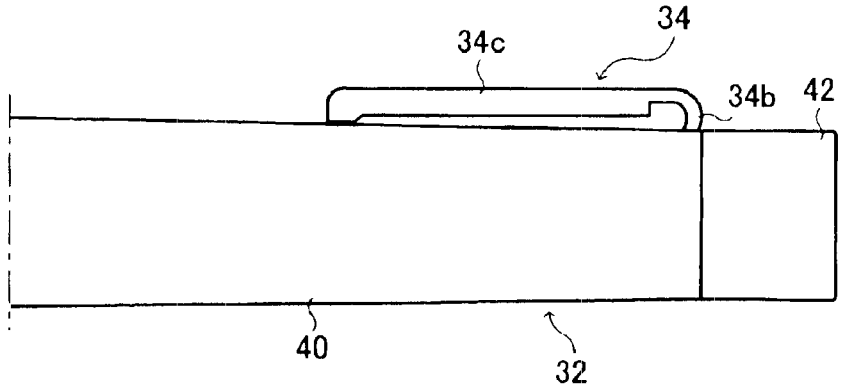
FIG. 8 is a side view of the second embodiment.
Figure 9:
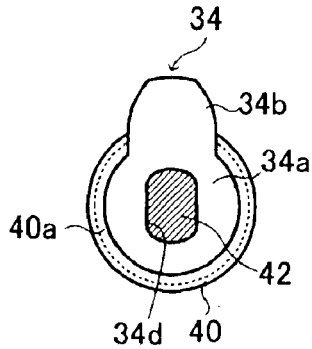
FIG. 9 is a cross sectional view seen along a line 9—9 of FIG. 7.

Now, FIG. 7 to FIG. 12 show a second embodiment of the present invention. FIGS. 7 and 8 show a part of a writing instrument, having the outer sleeve 32, to which a clip 34 is attached. The outer sleeve 32 has a cap main body (first outer sleeve) 40 and a tail plug 42 connected to the rear side of the cap main body 40. In the cap main body 40, a nut member 44 is provided. The tail plug 42 includes a reduced diameter portion in the tip portion thereof where a male threaded portion 42*a* is formed. The male threaded portion 42*a* extends in the cap main body 40 to be screwed into the nut member 44. The shape of the cross section of this male threaded portion 42*a* is a deformed circular shape in which the rim portions surrounded by two facing bowstrings and circular arcs connecting each bowstring are removed from a complete round. Alternatively, a screw member which is a separate part form the tail plug 42 can be provided, instead of forming the male threaded portion 42*a* integrated with the tail plug 42, the screw member and the tail plug 42 furthermore may be integrally connected by other connecting means such as the screwing, adhering, or pressing.

Figure 10:
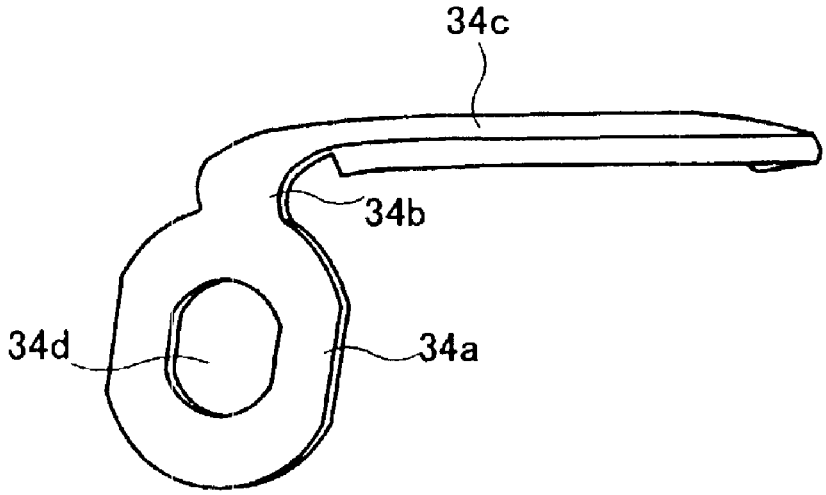
FIG. 10 is a perspective view of the clip of the second embodiment.

The clip 34 has a ring-like base portion 34*a* fixed to the outer sleeve 32, a connecting portion 34*b* extending from the base portion 34*a,* and a clip main body 34*c* extending approximately in parallel with the cap main body 40 from the connecting portion 34*b.* As shown in FIG. 10, an outside profile of the ring-like base portion 34*a* and a profile of the center hole 34*d* of the base portion 34*a* have a deformed circular shape in which the rim portions (referred as "removed portions") surrounded by two facing bowstrings and circular arcs connecting each bowstring are removed from a complete round. Furthermore, the connecting portion 34*b* has a curved shape so as to project backward.

Figure 11:
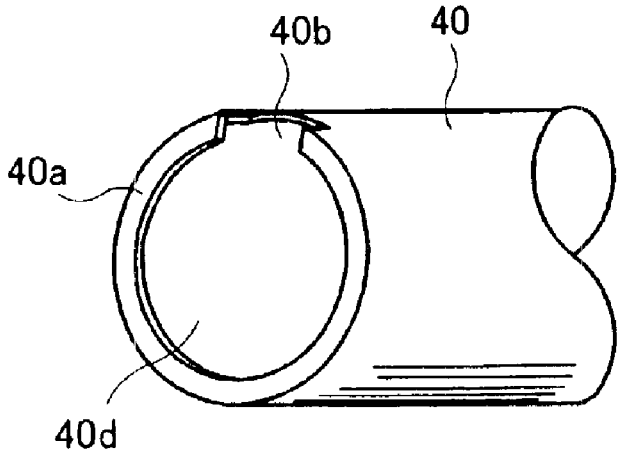
FIG. 11 is a perspective view showing a connecting side end portion (rear end portion) of a cap main body of the second embodiment.

The rear end portion as a connecting side end portion of the cap main body 40 is formed with a bent portion 40*a* bent in the inside diameter direction by 90 degrees as shown in FIG. 11. The inside diameter of this rear end portion except where the bent portion 40*a* is formed is approximately equal to or a little larger than the maximum length of the outside diameter of the outside profile of a deformed circle of the ring-like base portion 34*a* of the clip 34, that is, the length of the diameter not passing through the removed portion, furthermore, in other words, the maximum length in the longitudinal direction of the projection surface made by projecting the ring-like base portion 34*a* from the side. This means that the maximum length of the outside diameter of the outside profile of the ring-like base portion 34*a* of the clip 34 is larger than the inside diameter of a rear end opening 40*d* of the cap main body 40 surrounded and defined by the bent portion 40*a.*

At a specified position in the circumferential direction of the bent portion 40*a,* a notch 40*b* where there is no bending and the peripheral surface of the rear end portion thereof is scraped is formed. Since this notch 40*b* is made for the penetration of the connecting portion 34*b* of the clip, the size measured in the circumferential direction thereof is preferably and approximately as large as the size of the connecting portion 34*b* of the clip, and it should be not too larger than the size of the connecting portion 34*b* of the clip. The length in the diameter direction of the rear end opening 40*d* passing through the notch 40*b* is approximately equal to or a little larger than the minimum length of the outside diameter of the outside profile of the ring-like base portion 34*a* of the clip 34, that is, the outside diameter measured on the diameter passing through the removed portion.

Figure 12A:
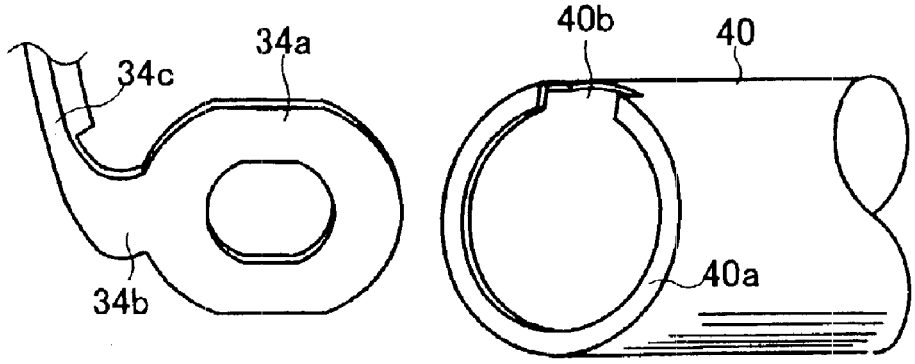
FIGS. 12A to 12D are views showing an assembling procedure of the clip of the second embodiment.
Figure 12B:
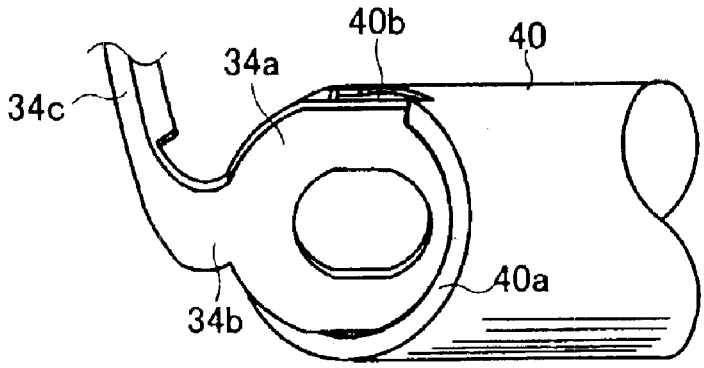
Figure 12C:
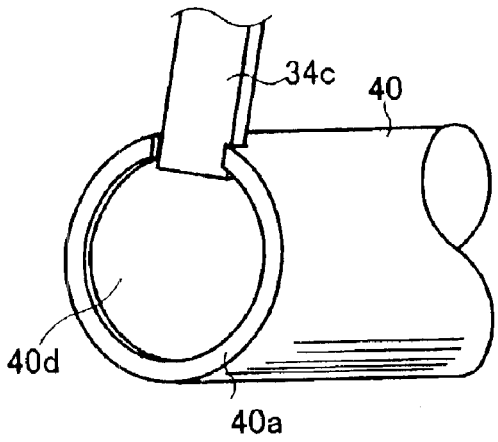
Figure 12D:
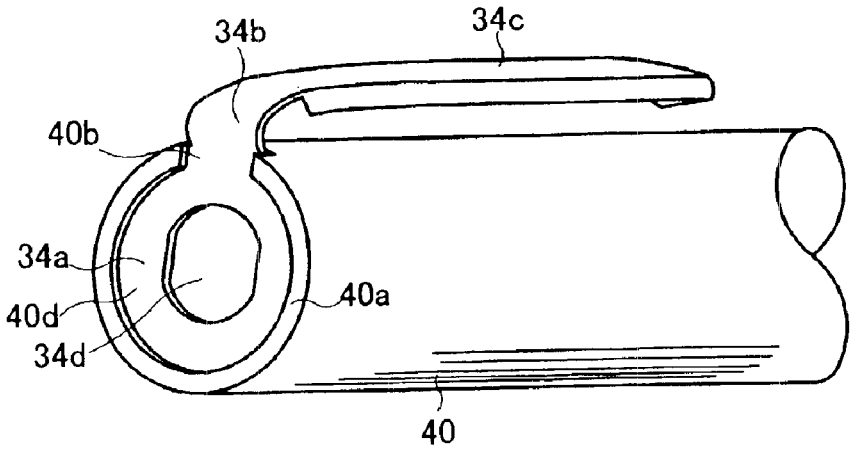

The assembling procedure of the clip attaching structure constructed as mentioned above, will be described. The base portion 34*a* of the clip 34 is inserted into the cap main body 40 from the bent portion 40*a* of the cap main body 40. Since the maximum length of the outside diameter of the outside profile of the base portion 34*a* is approximately equal to the inside diameter of the cap main body 40 except where the bent portion 40*a* is formed, and is larger than the inside diameter of the rear end opening 40*d* of the cap main body 40 surrounded by the bent portion 40*a,* the base portion 34*a* as it is cannot be inserted into the cap main body 40 over the bent portion 40*a*. However, since the length in the diameter direction of the rear end opening 40*d* passing through the notch 40*b* is approximately equal to or a little larger than the minimum length of the outside diameter of the outside profile of the ring-like base portion 34*a* of the clip 34, that is, the outside diameter measured on the diameter passing through the removed portion, the base portion 34*a* can pass through the bent portion 40*a*. As shown in FIG. 12A, the base portion 34*a* of the clip 34 is set to be approximately vertical to the rear end opening 40*d* surface surrounded by the bent portion 40*a,* and is allowed to pass through the portion in the diameter direction of the rear end opening 40*d* connecting the notch 40*b* and the axial center of the cap main body 40 to pass through the bent portion 40*a*. Then, after inserting the base portion 34*a* approximately completely into the cap main body 40, the clip 34 is rotated (FIG. 12B) so that the connecting portion 34*b* coincides with the notch 40*b*. Furthermore, the clip 34 is rotated (FIG. 12C) so that the center hole 34*d* of the base portion 34*a* of the clip 34 is approximately in parallel with the rear end opening 40*d* surface of the cap main body 40. Thus, the base portion 34*a* of the clip 34 is contained in the inside of the bent portion 40*a* of the cap main body 40, and the connecting portion 34*b* of the clip 34 penetrates the notch 40*b,* and the clip main body 34*c* of the clip 34 extends approximately in parallel with the cap main body 40 (FIG. 12D).

The male threaded portion 42*a* of the tail plug 42 is then allowed to penetrate the rear end opening 40*d* surrounded by the bent portion 40*a* of the cap main body 40, and the center hole 34*b* of the base portion 34*a* of the clip 34. The male threaded portion 42*a* has approximately the same shape as the center hole 34*d* of the base portion 34*a* of the clip 34, so that the cap main body 40 is prevented from rotating relative to the base portion 34*a* of the clip 34. Then, the nut member 44 provided in the inside of the cap main body 40 is rotated to the male threaded portion 42*a* so that both are threadedly engaged with each other. Consequently, the tail plug 42 is connected to the cap main body 40, and the base portion 34*a* of the clip 34 is held and fixed between the nut member 44 and the bent portion 40*a* since it cannot pass through the bent portion 40*a*. Furthermore, a part of the portion curved to project backward of the connecting portion 34*b* of the clip 34 penetrating the notch 40*b* comes into contact with the end surface of the rear portion of the tail plug 42. Preferably, the portion where the connecting portion 34*b* comes into contact with the tail plug 42 is positioned at or near the rearmost end of the connecting portion 34*b*.

The base portion 34*a* of the clip 34 attached to the outer sleeve 32 as mentioned above is positioned in the cap main body 40, as shown in FIG. 8, and is not seen from the outside, and therefore, it has an excellent appearance. Furthermore, when the clip main body 34*c* is swung for using the clip 34, a large deformation of the connecting portion 34*b* itself can be prevented since the connecting portion 34*b* of the clip 34 is brought into contact with the tail plug 42, and since the connecting portion 34*b* is curved, the stress applied to the connecting portion 34*b* can be prevented from concentrating, and the clip 34 can be prevented from breaking. At the same time, the restoring force of the clip 34 can also be raised.

Furthermore, in each of the embodiments, the bent portions 20*a,* 40*a* of the rear sleeve 20 or the cap main body 40 are formed, and in the inside thereof, the base portions 14*a,* 34*a* of the clips 14, 34 are positioned, but it is also possible that the bent portions are provided with the cap 22 or the tail plug 42, and in the inside thereof, the base portions 14*a,* 34*a* of the clips 14, 34 are positioned.

As mentioned above, according to the present invention, the base portion of the clip passes through the bent portion of one of the first outer sleeve and the second outer sleeve to be positioned in the inside thereof, the base portion of the clip is not seen from the outside, and a good appearance can be obtained and the clip is surely attached to the outer sleeve. Furthermore, if the connecting portion of the clip is curved to project backward so that a part of the connecting portion is brought into contact with the second outer sleeve, the clip is prevented from breaking.

While the invention has been described in terms of several preferred embodiments, those skilled in the art will recognize that the invention can be practiced with modification within the spirit and scope of the appended claims.

What is claimed is:

1. A clip attaching structure comprising:

an outer sleeve including a first outer sleeve and a second outer sleeve connected to a rear side of said first outer sleeve; and a clip including a ring-like base portion fixed to the outer sleeve, a connecting portion extending from said base portion, and a clip main body extending substantially in parallel with the outer sleeve from said connecting portion;

wherein a connecting side end portion of one of the first outer sleeve and the second outer sleeve is bent from the axial direction by about 90 degrees to be a bent portion extending in the inside diameter direction to surround a connecting side opening of one of the first outer sleeve and the second outer sleeve, two notches are formed to be separated by about 180 degrees and facing to each other in the circumferential direction in the bent portion, and a length in a diameter direction of the connecting side opening connecting said two notches is one of equal to and greater than a minimum length in the longitudinal direction of a projection surface made by projecting the ring-like base portion of said clip from a side thereof, whereas a length in the diameter direction of the connecting side opening not connecting said two notches is one of equal to and less than a maximum length in the longitudinal direction of the projection surface made by projecting the ring-like base portion of said clip from the side thereof, and the ring-like base portion of the clip is capable of passing through the portion in the diameter direction of the connecting side opening passing through said notch, to be inserted into the inside of one of said first outer sleeve and second outer sleeve, and the base portion of the clip passing through the bent portion is positioned in the inside of one of the first outer sleeve and second outer sleeve, whereby the clip is attached to the outer sleeve, and the connecting, portion of said clip penetrates one of said two notches.

2. The clip attaching structure according to claim 1, wherein an outside profile of the ring-like base portion of said clip includes a deformed circle where a rim thereof is removed from a complete round, and the length in the diameter direction of the connecting side opening connecting said two notches is one of equal to and more than the minimum length in the longitudinal direction of the projection surface made by projecting the ring-like base portion of said clip from the side thereof.

3. The clip attaching structure according claim 1, wherein said connecting portion of said clip is curved to project backward so that a portion of the connecting portion comes into contact with said second outer sleeve.

4. The clip attaching structure according to claim 2, wherein said connecting portion of said clip is curved to project backward so that a portion of the connecting portion comes into contact with said second outer sleeve.

5. A clip attaching structure comprising:

an outer sleeve including a first outer sleeve and a cap connected to a rear side of said fist outer sleeve; and a clip including a ring-like base portion fixed to the outer sleeve, a connecting portion extending from said base portion, and a clip main body extending substantially in parallel with the outer sleeve from said connecting portion;

wherein a connecting side end portion of the first outer sleeve is bent from the axial direction by about 90 degrees to be a bent portion extending in the inside diameter direction to surround a connecting side opening of the first outer sleeve, two notches are formed to be separated by about 180 degrees and facing to each other in the circumferential direction in the bent portion, and a length in the diameter direction of the connecting side portion connecting said two notches is one of equal to and greater than the minimum length in the longitudinal direction of a projection surface made by projecting the ring-like base portion of said clip from a side thereof, whereas a length in the diameter direction of the connecting side opening not passing through the notches is one of equal to and less than a maximum length in the longitudinal direction of the projection surface made by projecting the ring-like base portion of said clip from side thereof; and the ring-like base portion of the clip is capable of passing through the portion in the diameter direction of the connecting side opening passing through said notch, to be inserted into the inside of the first outer sleeve, wherein the base portion of the clip, passing through the bent portion is positioned in the inside of one of the first outer sleeve and second outer sleeve, whereby the clip is attached to the outer sleeve, and wherein the connecting portion of said chip penetrates one of said two notches.

6. A clip attaching structure comprising:

an outer sleeve including a first outer sleeve and a second outer member connected to said first outer sleeve; and a clip including a ring-like base portion fixed to the outer sleeve;

wherein a connecting side end portion of the first outer sleeve includes a bent portion that is bent from an axial direction by substantially 90 degrees and extends in an inside diameter direction to surround a connecting side opening of the first outer sleeve, wherein said bent portion includes at least two notches separated by substantially 180 degrees and facing each other in the circumferential direction in the bent portion, wherein the ring-like base portion of the clip is capable of passing through a portion in a diameter direction of the connecting side opening passing through said at least two notches, to be inserted into the inside of said first outer sleeve, and wherein a base portion of the clip passing through the bent portion is positioned in the inside of the first outer sleeve, whereby the clip is attached to the outer sleeve.

7. The clip attaching structure according to claim 6, wherein a length in a diameter direction of the connecting side opening passing through said at least two notches is one of equal to and greater than a minimum length in a longitudinal direction of a projection surface made by projecting the ring-like base portion of said clip from a side thereof.

8. The clip attaching structure according to claim 6, wherein a length in a diameter direction of the connecting side opening which does not pass through the at least two notches is one of equal to and less than a maximum length in a longitudinal direction of a projection surface made by projecting the ring-like base portion of said clip from a side thereof.

9. The clip attaching structure according to claim 6, wherein a length in the diameter direction of the connecting side opening connecting said two notches is one of equal to and more than the minimum length in a longitudinal direction of the projection surface made by projecting the ring-like base portion of said clip from a side thereof.

10. The clip attaching structure according to claim 6, wherein said clip further includes a connecting portion extending from said base portion and a clip main body extending substantially in parallel with the outer sleeve from said connecting portion.

* * * * *